US010935339B2

(12) United States Patent
Hughes et al.

(10) Patent No.: US 10,935,339 B2
(45) Date of Patent: Mar. 2, 2021

(54) ADJUSTMENT SYSTEM FOR TRAINING PISTOL

(71) Applicant: NextLevel Training LLC, Ferndale, WA (US)

(72) Inventors: Michael Hughes, Maple Falls, WA (US); Seth Rich, Ellensburg, WA (US); Britton Lentz, Everson, WA (US); Thomas Swetish, Bellingham, WA (US)

( * ) Notice: Subject to any disclaimer, the term of this patent is extended or adjusted under 35 U.S.C. 154(b) by 0 days.

(21) Appl. No.: 16/784,342

(22) Filed: Feb. 7, 2020

(65) Prior Publication Data

US 2021/0010777 A1 Jan. 14, 2021

Related U.S. Application Data

(63) Continuation-in-part of application No. 16/509,518, filed on Jul. 12, 2019, now Pat. No. 10,557,685, which is a continuation-in-part of application No. 15/407,272, filed on Jan. 17, 2017, now Pat. No. 10,352,646.

(60) Provisional application No. 62/280,027, filed on Jan. 18, 2016.

(51) Int. Cl.
*F41A 33/02* (2006.01)

(52) U.S. Cl.
CPC ..... *F41A 33/02* (2013.01)

(58) Field of Classification Search
CPC ..... F41A 33/00; F41A 33/02; F41A 33/04; F41A 33/06; F41G 3/26; F41G 3/2655; F41G 1/545
See application file for complete search history.

(56) References Cited

U.S. PATENT DOCUMENTS 8,556,628 B1 * 10/2013 Baxter ..... F41A 33/00 434/16
9,151,564 B1 * 10/2015 Baxter ..... F41A 19/10
2019/0041164 A1 * 2/2019 Hughes ..... F41A 3/66

* cited by examiner

*Primary Examiner* — Timothy A Musselman
(74) *Attorney, Agent, or Firm* — Michael F. Hughes

(57) ABSTRACT

A training pistol having an adjustable trigger with a shot-indicating laser to signify the impact of a shot which would simulate a bullet hole of a live fire pistol. In one form a trigger prep indicating system to indicate where the trigger is pressed showing the trigger finger is on the trigger and the trigger is repositioned from a rest state to a position longitudinally rearward therefrom.

10 Claims, 17 Drawing Sheets

ADJUSTMENT SYSTEM FOR TRAINING PISTOL

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever, Copyright, Designs and Patents Act 1988.

BACKGROUND

This application is a detailed specification of U.S. Non-Provisional application No. 62/280,027 filed on Jan. 18, 2016 and an application Ser. No. 15/407,272 filed on Jan. 17, 2017 having title "TRAINING PISTOL"; and Ser. No. 16/509,518 filed on Jul. 12, 2019; the disclosure of which is incorporated herein by reference in its entirety.

Firearms are the great equalizer empowering the physically weak and allowing nations to empower the populace to be the ultimate checks and balances. Firearms are ingrained in United States culture embedded with the Second Amendment and exemplified by significant increase in firearms sales in recent years.

The firearm is a tool, it is by itself an inert device that cannot do anything upon its own accord. The latest technological developments in firearm quality ensures the gun will not go off unless the trigger is pulled. The ergonomic design of firearms substantially ensures the trigger will not get pulled unless the finger is in that trigger guard and presses the trigger rearwardly with respect to the frame of a handgun. Proficiency is inextricably intertwined with safety. The more proficient a firearm handler is the more the safe they will be. In a similar vein as driving an automobile, the more practice, the more handling, the more situations all breeds better driving. Although driving is plagued with distraction which is a primary cause for accidents, firearms have further growth in the area of training to further increase safe handling with the firearm. Generally speaking, most shooters have an awareness of the extreme and immediate energy a firearm can produce. This energy of course can be used for self-defense and a plurality of firearm competitions. But the firearm culture needs a practical means for training where training is accessible, convenient, inherently diagnostic.

One very practical safety-related skill is keeping the finger off the trigger until ready to shoot. The patent application which is owned by the assignee U.S. Pat. No. 8,646,201 describes the first version of the very commercially successful SIRT training pistol. The application herein describes the next generation of the SIRT training pistol which are broadly defined within the claims, but one aspect of the disclosure herein is heavy emphasis on the trigger movement detector so when the firearm handler presses the trigger there is an indication as to when and, essentially, where (how far) the trigger was depressed. In one form this is an adjustable feature so as to allow for a laser to activate when the trigger is first depressed all the way to when it is fully prepped or even beyond the break point.

One skill required in law enforcement and other individuals required to carry a pistol (as well of course the massive private sector and dedicated citizens that choose to carry a gun) is keeping the finger off the trigger until ready to shoot. It is unfortunately not uncommon where a shooter will place their finger on the trigger at an inappropriate time. For example, when the lights go off there is a higher probability that the firearm handler may put their finger on the trigger and "feather" the trigger almost as if they're making sure the trigger is still there. This can be very dangerous because the firearm handler can clench and have an up to twenty-pound force in the trigger finger which is more than ample to ignite the firing process. Of course the fundamental safety rules are redundant and if the gun is pointed in a safe direction the expelled round should not do harm; however, the rules are by their very nature completely redundant and an unintentional discharge in this manner is a significant breech of proper gun handling.

Training has to be practical, has to be economical and not require significant resources. There are over 18,000 law enforcement departments ranging from state to federal in the United States. Most of these departments are smaller departments such as local cities and sheriff police agencies. The firearm instructor likely has other duties and obligations and budgets are always tight where training is prone to get reduced unfortunately.

Therefore, having an economic solution with inert training pistols that are safe and multifaceted where in one form the training pistol can be adjusted so as the trigger will activate a laser when it is slightly touched. Therefore, for example if a police agency is doing house entry training in a stack where multiple officers are behind one another preparing to enter a room, a trainer or even the fellow officers will be able to know when one of the officers "feathers" a trigger by activation of the laser. This is particularly pronounced in low light training. Not only is the laser on but the laser beam generally pointed forward of the muzzle can indicate the general orientation of the muzzle when the trigger was pressed or even partially pressed.

Therefore, as much as speed and accuracy has to be emphasized, the very fundamental training tenets of "finger off the trigger 'til ready to shoot" has to be ingrained in the training and technology has to support these training tenets. But in addition to the ingrained safety training within a training regimen, the raw skills of speed and accuracy, grip establishment, natural point of aim in close targets, the use of sights at further targets and knowing when to use sights, trigger control (the ability to break a shot without disturbing the muzzle). Then of course a plurality of skillsets as reloads, slide lock stimulus recognition (to be trained with live fire pistols) single hand manipulation including single hand malfunction clearances, single hand reloads, etc. Then training expands to other areas such as compromised/awkward shooting positions, prone shooting, supine prone as well as rollover prone (getting on the ground) as well as general visual awareness in ensuring there's no liabilities down range. There's so many areas to train and resources are limited.

The device disclosed herein is an inert pistol designed to train a majority of these skillsets safely. Of course recoil management, slide lock stimulus and malfunction recognition and clearance are skills that have to be trained on the range. These skills require the raw kinetic energy inertia of a firing bullet to train properly and the only space to train these three skills is with a live fire tool. The remainder of the skills can be trained off the range in very high volume and very frequently. High volume (frequent) trainings is an ideal way for learning motor neuron skills. Shooting is primarily motor neuron endeavor but also a very cognitive one as well. The motor neuron skills of establishing a grip knowing when you can shoot with minimal reference to the sights by the feel of the grip and further knowing your limitations of your point shooting to know when you have to rely on the sights.

This skill requires thousands upon thousands of repetitions. It is a fool's journey to only build this skill on the range. Dry firing has been around since the dawn of guns. Dry firing is simply not firing a round but going through the motion of aligning the muzzle, supporting the firearm and pulling the trigger without the boom. A live fire gun has some potential risks of a round going off. A dedicated dry fire tool aids in the safety of dry firing and further simply makes dry firing more accessible because an inert tool such as that described herein can be around the house, training room, etc. and not have the same practical legal implications as with a live fire tool (simply because a live fire gun is a serial numbered federal firearm licensed device and losing it has more implications than losing an inert tool that cannot fire a round).

Therefore, the inert tool described herein has a plurality of uses. In essence, do what you do with your live fire gun but do it dry and do it safely and do it a lot. Train the skills (noted above) throughout your day even in 10-second short trainings, unearth the deficiencies, note the impact of the shot-indicating laser and determine was it a good hit or bad hit. Did the laser move showing a trigger mechanic issue (moving the muzzle and breaking the shot) or was it a nice clean dot? Was the dot right in the target area (acceptable accuracy zone) or was it outside? The assignee is an entity dedicated to training and raising the bar of proficiency which inherently raises the safety. And one subset of training is the dedicated focus on the fundamental safety rules and ingraining these safety rules into the fabric of the training curriculum. The trigger prep indication system can be used for performance aspects of prepping the trigger at an appropriate time (that is taking the slack) as well as dedicated training segments ensuring the trigger is not pressed at all at inappropriate times.

The training benefits are beyond the scope of this patent document but the preferred embodiment is described herein where of course it is understood that other forms of the broadly claimed invention can be carried out but clearly remain within the scope of the claims herein.

DETAILED DESCRIPTION OF PREFERRED EMBODIMENTS

Figure 1:
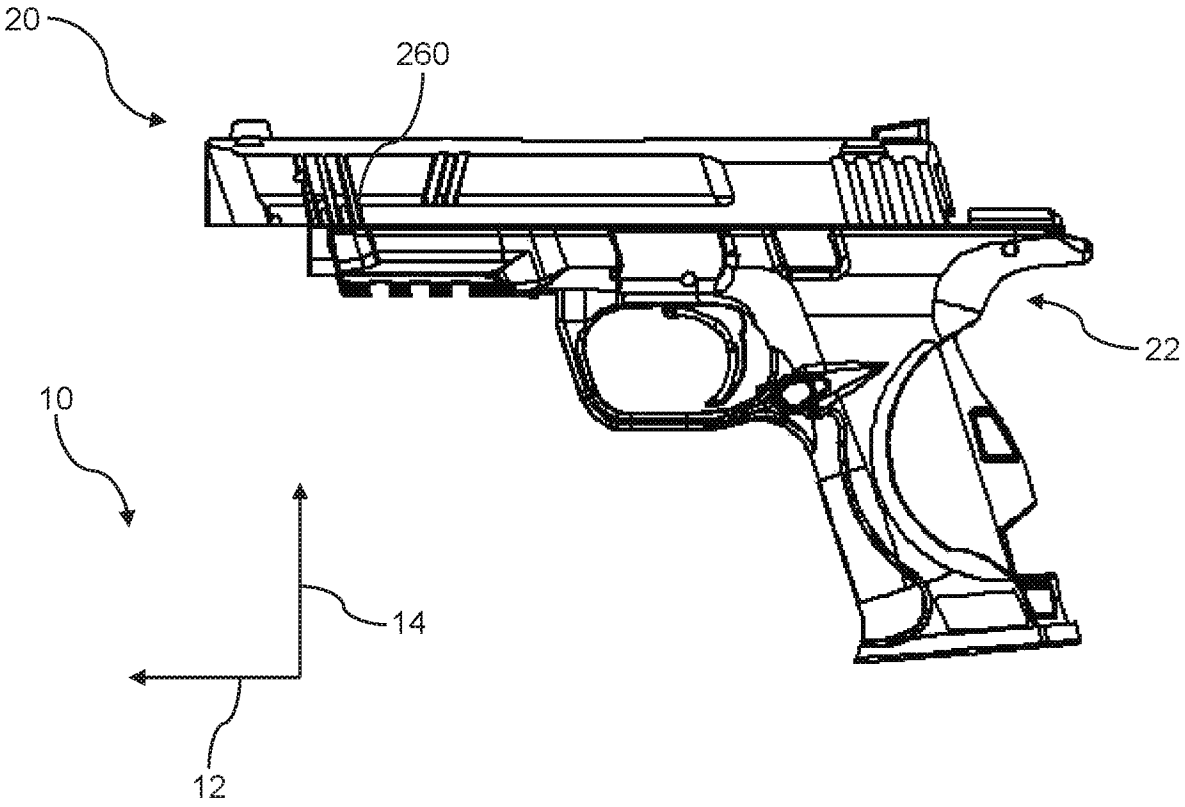
FIG. 1 is a side profile view of the training pistol.
Figure 2:
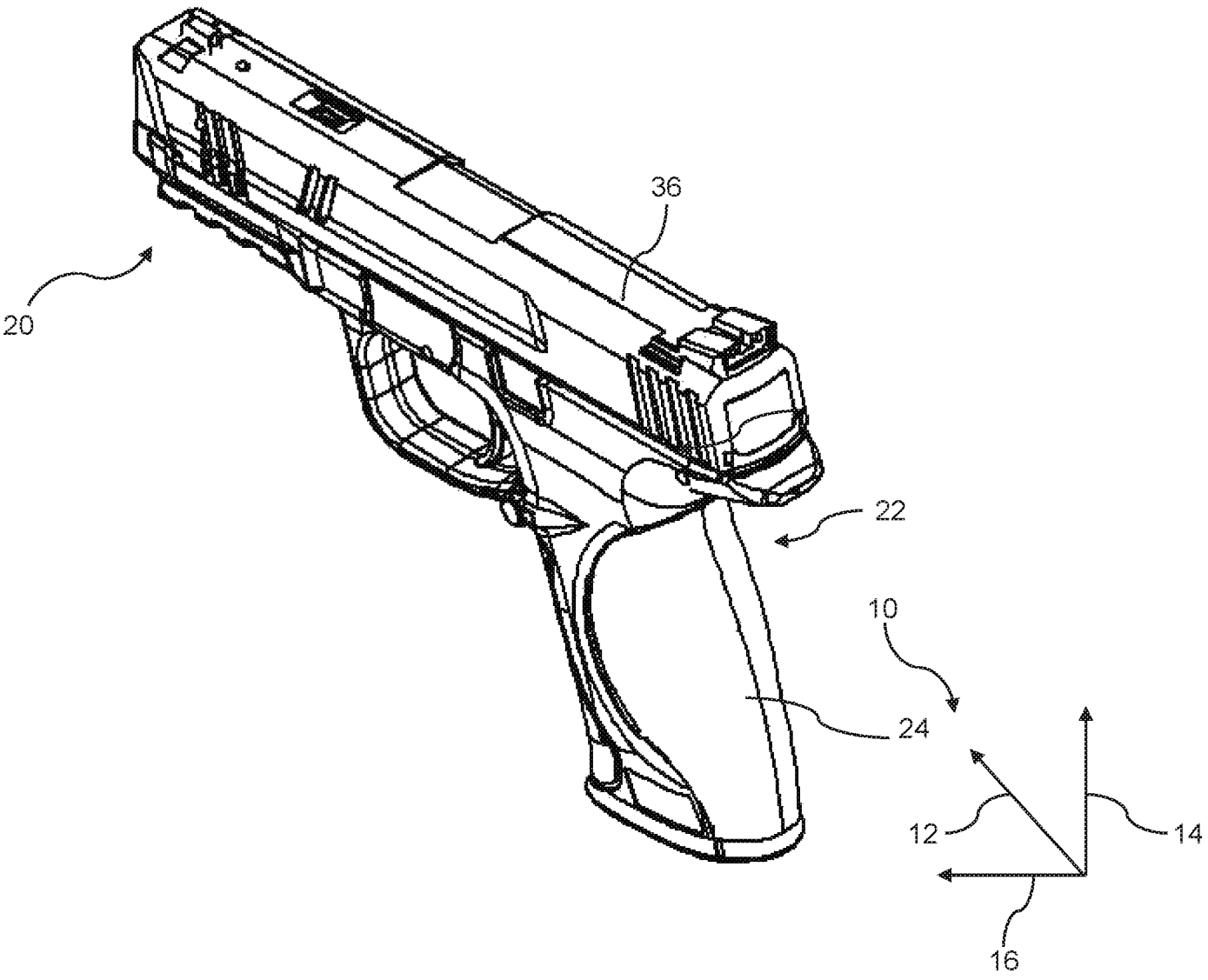
FIG. 2 is an isometric view of the training pistol generally showing an access system to help aid the description of one preferred embodiment of carrying out the orientation of the components.

As shown in FIG. 1, there is a training pistol 20. To aid in the description of the training pistol 20 an axis system is defined where the axis system 10 has the longitudinal access 12 which is pointed in a forward direction where the opposing direction of arrow 12 is a longitudinal forward direction. The axis indicated at 14 is a vertical axis with the arrow in direction in an upward or vertically upward direction and the opposing direction would be a downward direction. The axis to 12 and 14 is a lateral axis indicated on FIG. 2 at 16. The lateral axis as shown in FIG. 2 is pointed in a left direction where the opposing direction will be a right direction. In no way are the axis indicated to be limiting the scope of invention where for example if the training pistol was upside down obviously with respect to the Earth the vertical direction is downward whereas for purpose of reference of the general components for a best current mode to create the training pistol 20 the axis system 10 is generally used to communicate the orientation of the components at preferred mode of (but not the exclusive mode) of arranging the components described herein. This document incorporates by reference patent U.S. Pat. No. 8,646,201 by the assignee which is fully incorporated by reference and a disclosure therein is intended to be a basis for any claimed subject matter as well.

Figure 3:
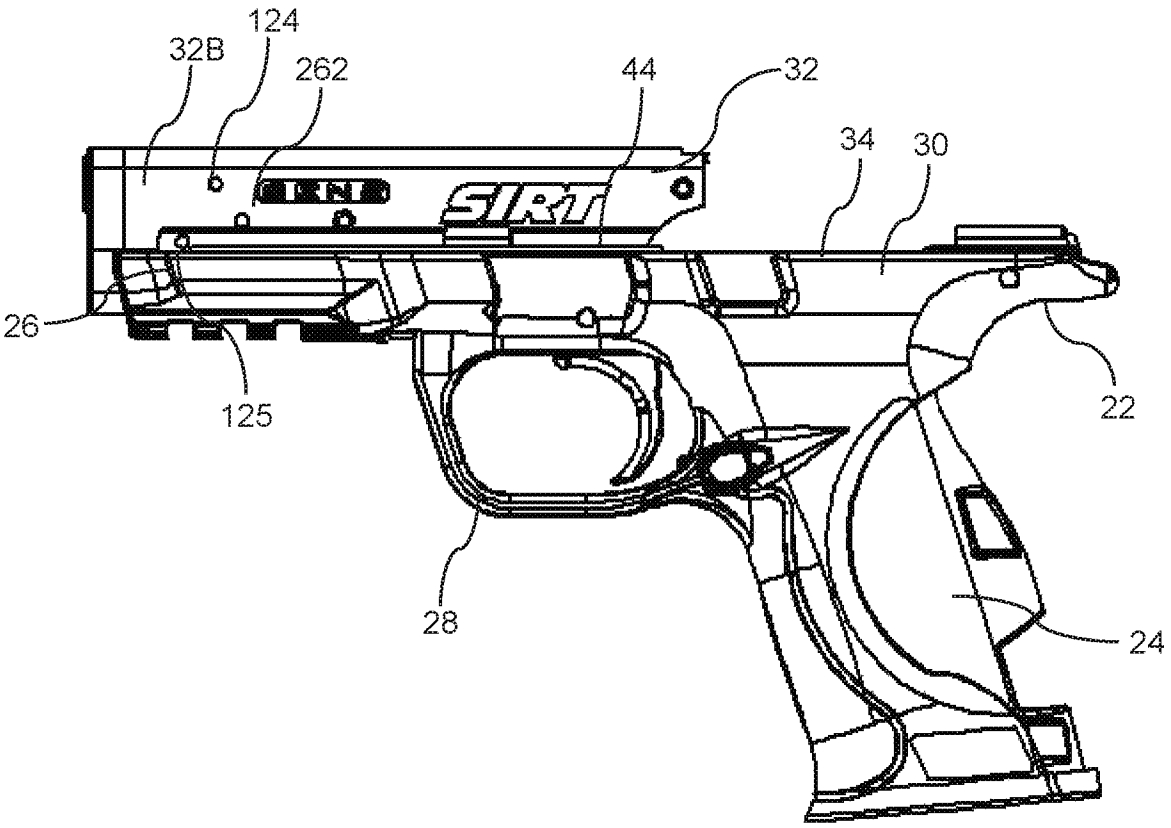
FIG. 3 is a side view of the pistol with the slide removed showing which in one form has a module frame which is fit within a grip frame.

As shown back in Figure No. 1, there is a frame 22. As shown in FIG. 3, the frame 22 has a handle region 24 and an upper region 26. The frame 22 further has a trigger guard 28.

Figure 4:
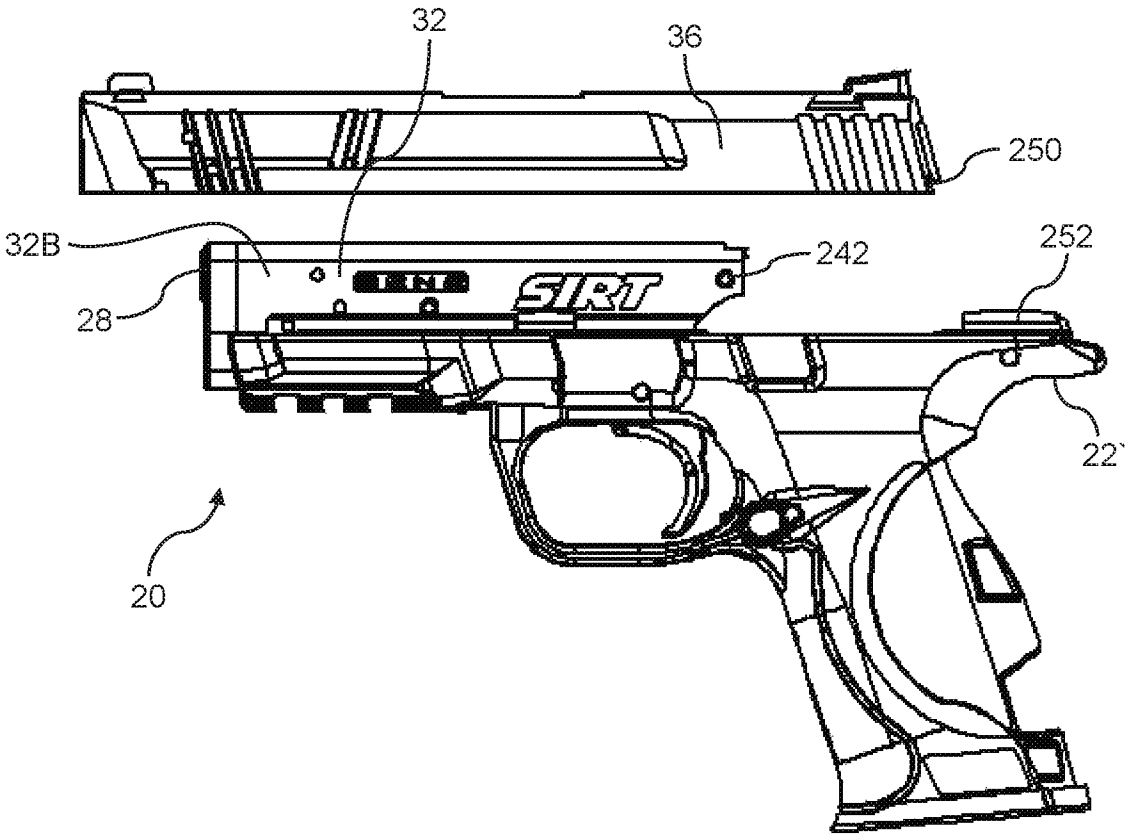
FIG. 4 shows a partially exploded view of a slide fit there above the frame.

In one preferred form, the frame portion 22 has a grip frame 30 and a module frame 32. In one preferred form the grip frame 30 and the module frame 32 are two separate components and the grip frame 30 has a surface defining and interior cavity 34 for the module frame to fit therein. As shown in FIG. 4 the slide 36 is configured to fit on the frame 22. The attachment of slide 36 to that frame portion 22 will be further described hereinafter a more detailed description of the trigger system.

Figure 5:
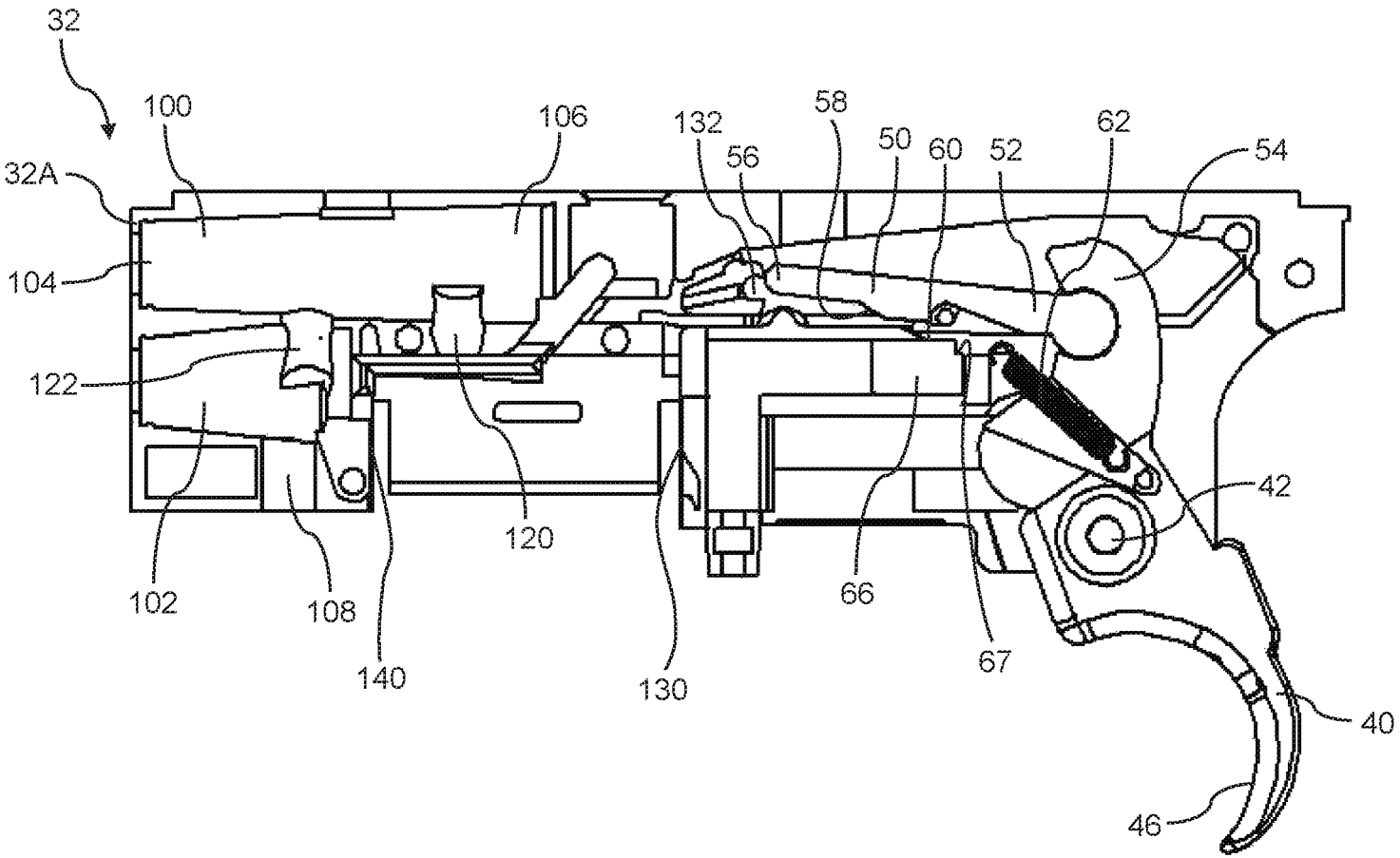
FIG. 5 shows a view of the module frame with a side portion of the module frame (left housing member) removed to show one form of the interior components.

Referring now to FIG. 5, there is shown the half section of the module frame 32. In one preferred form the module frame 32 is split into two sections for ease of assembly where the components can be laid into the right half section 32(*a*) as shown in FIG. 5 (whereas numeral. 32 is designated one half of the module frame in FIG. 5).

The trigger 40 in one form is pivotally attached at the pivot point 42. The pivot point 42 can be attached to the module frame 32 with a pin extending there through. A pin can further extend through the grip frame 30 to aid in attaching the module frame 32 to the grip frame 30 (as seen in FIG. 3) and a trigger pin 44 can provide such an attachment and can for example be a one eighth inch roll pin in one preferred form of carrying out the preferred embodiment.

Referring back to FIG. 5, the trigger 40 has a finger engagement portion 46 which is a longitudinally forward portion of the trigger 40 and operatively configured to have the index finger of the trigger finger of a firearm handler to press there against to reposition the trigger from a forward longitudinal location to a rearward longitudinal location. In other words, in a resting state the trigger 40 is in a forward most location and is operatively configured to move in a longitudinally rearward location with respect to the frame 22.

In one form the trigger is comprised of a trigger bar 50. The trigger bar 50 has a base region 52 where in a preferred form the base region 52 is pivotally attached to the upper portion 54 of the trigger 40. The trigger bar 50 further has a switch activating region 56. The trigger bar further has a disengagement surface 58 and a trigger sear 60. The trigger sear and disengagement surface will be further described herein following a final description of the housing and the trigger assembly.

In general, the trigger 40, the trigger bar and a trigger bar spring 62 comprise a trigger assembly. In a broader scope the trigger assembly could be one integral piece such as a trigger bar that is integral or flexibly attached to a trigger 40 but in a preferred form the trigger bar is rotationally attached to the trigger and the trigger bar spring applies a torque on the trigger bar so it is biasedly engaged towards the trigger block described below.

Figure 6:
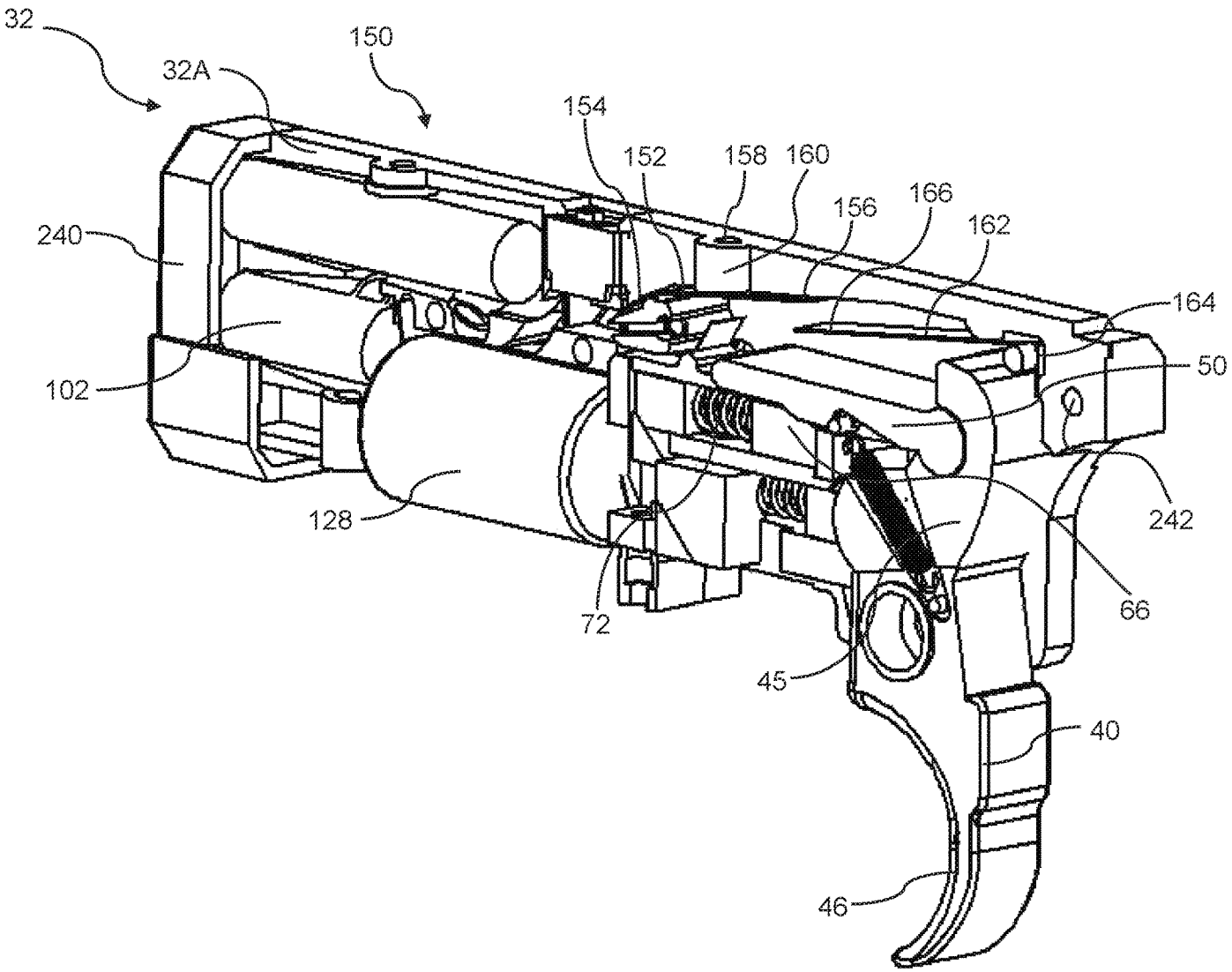
FIG. 6 shows an isometric view of the components shown in FIG. 5.
Figure 7A:
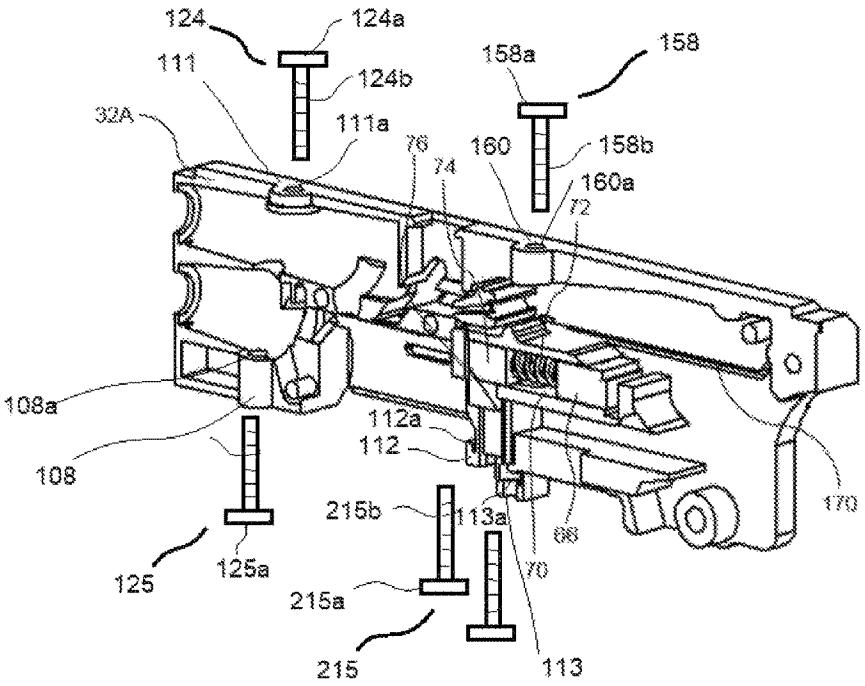
FIGS. 7 and 7A show a right half of the module frame with a view of the components related to the trigger break adjustment system contained therein.
Figure 7:
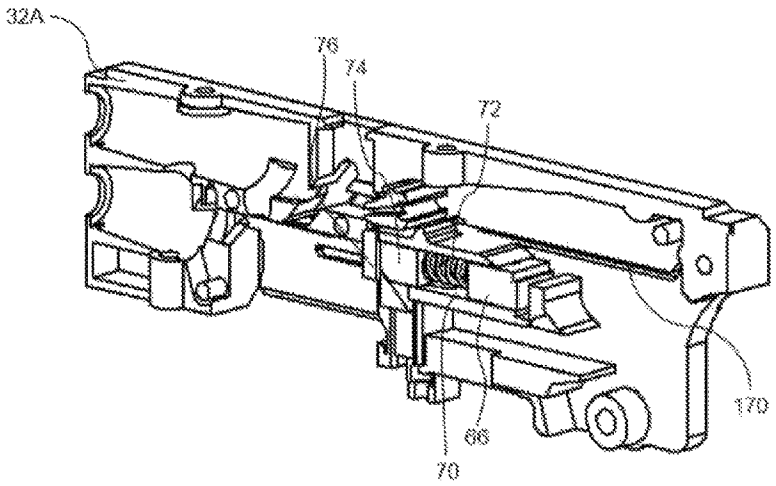
Figure 8:
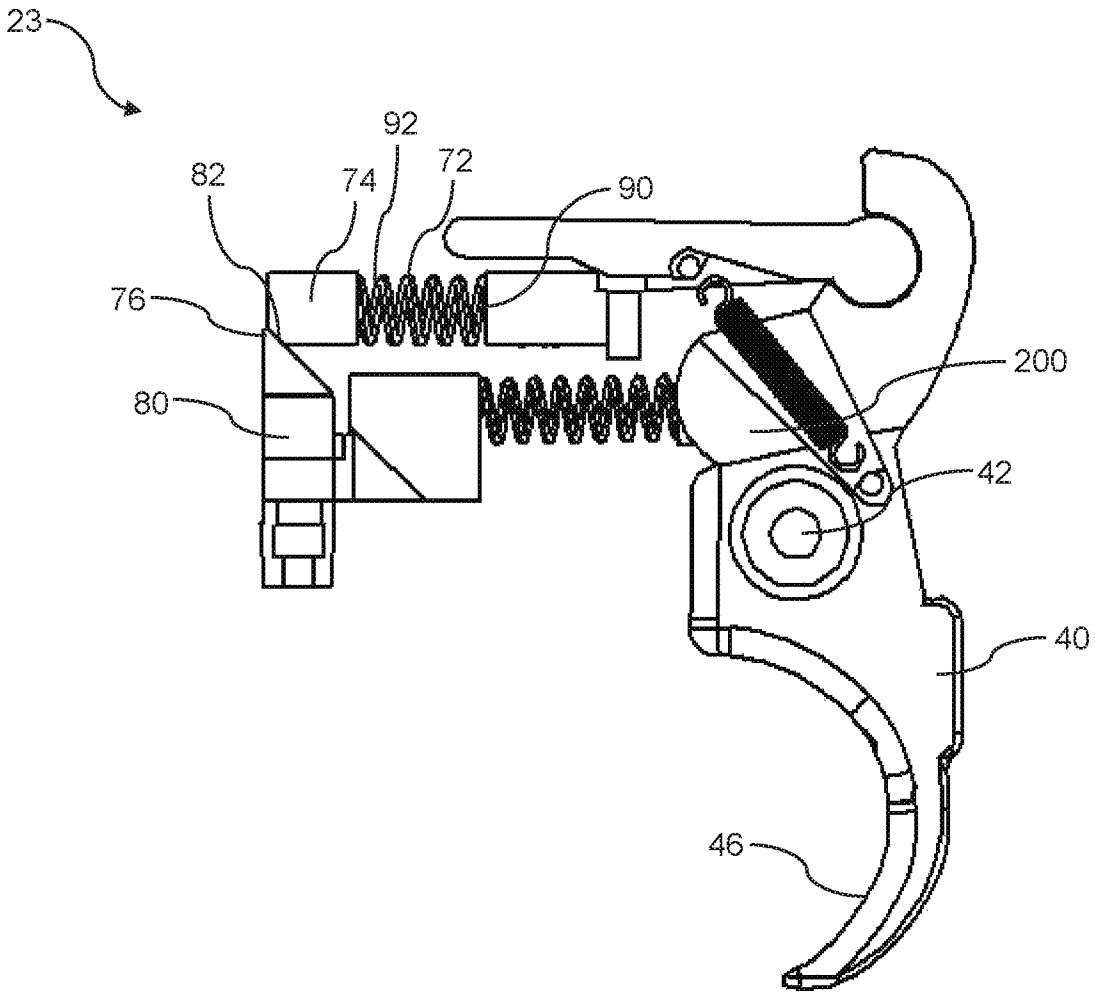
FIG. 8 shows a trigger adjustment system having adjustment for the trigger break and trigger prep force values.
Figure 9:
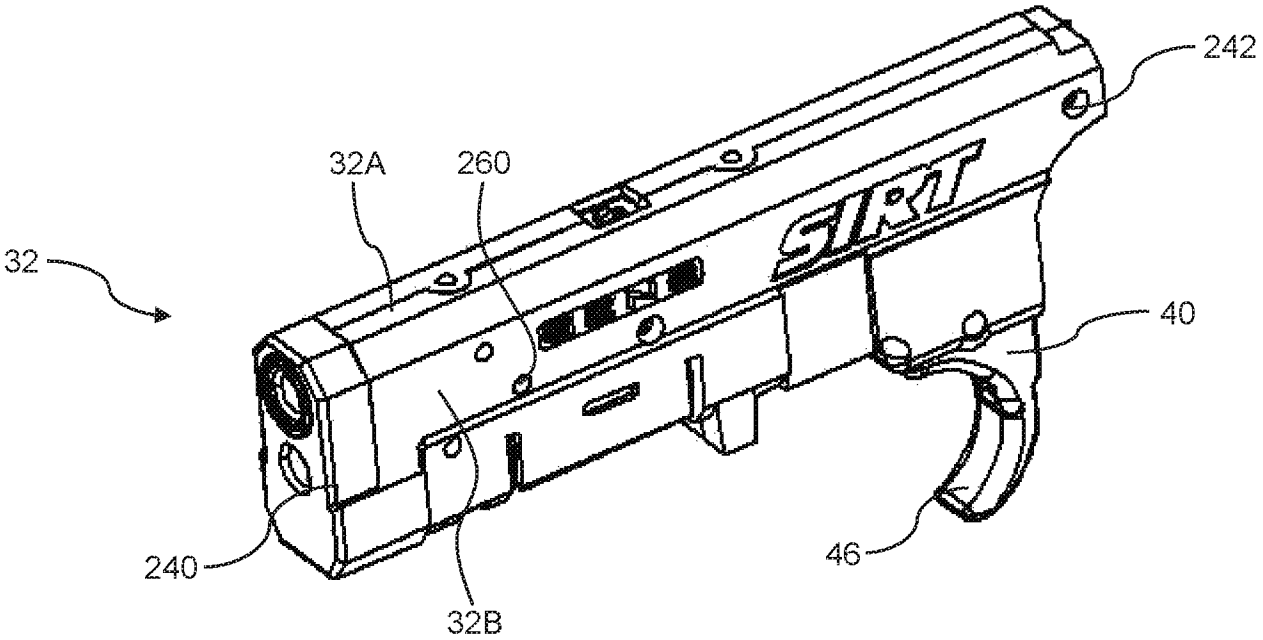
FIG. 9 is a isometric view of the trigger and laser assembly.

Still referring to FIG. 5, the trigger block 66 is movably attached to the right housing member 32A. Now referring to FIG. 6, there is shown an orthogonal view of a portion of the module frame 32. As shown in this figure the trigger block 66 is shown to fit within the channel defined by the surfaces 70 as shown in FIG. 7. The channel 70 in FIG. 7 can be part of the right housing member 32A to provide substantially linear motion of the trigger block 66. The biasing member 72 in one form is a coil spring and can fit within a cavity within the trigger block and further fit within a cavity in the trigger break adjustment block 74. Still referring to FIG. 7, it can be seen that the trigger break adjustment block 74 has a second angled surface 76. Referring now to FIG. 8, there is a side view of the trigger adjustment system 23. (Without the housing which confines and constrains the components shown in FIG. 8). It can be seen in FIG. 8 that the trigger break adjuster 80 has a first angled surface 82 that is operatively configured to engage the second angle surface 76 of the trigger break adjustment block 74. Therefore, when the trigger break adjuster moves vertically upward the trigger break adjustment block 74 moves to the right and precompresses the biasing member 72. The biasing member 72 generally has a trigger block end 90 and a adjustment end 92 as shown in FIG. 8. As noted above in a preferred form the biasing member is a helical spring and housed within the two blocks on either end.

With the foregoing description in place it can be generally appreciated that the trigger break can be adjusted so as the amount of force applied to the trigger 40 at the finger engagement portion 46 can have a dramatic feel to the break of the trigger based on the precompression of the biasing member 72. Referring now to FIG. 6, it can be appreciated that as the trigger 40 moves longitudinally rearward presumably by force upon the finger engagement portion 46 the trigger bar 50 will reposition longitudinally forward and as shown in FIG. 5, the trigger sear 60 will eventually slide up and past the block sear 67 of the trigger block 66, and the trigger bar 50 will continue longitudinally forward where the switch activating region 56 closes the circuit and the shot indicating laser activates.

Therefore a sufficient amount of the core componentries now described to at least get an overall appreciation for the operation of the pistol of the training pistol 20. There will now be a more general discussion of the overall components followed by further discussion of the secondary adjustment system for the trigger prep which will be described further below in FIG. 8 and FIG. 10.

As shown in FIG. 5, there's a portion of the module frame 32 where the right housing member 32(*a*) is shown. Within this right housing member 32(*a*) there is a shot indicating laser 100 and a trigger prep indicator 102. One preferred form the shot indicating laser 100 has a front portion 104 and a rearward portion 106. Set screws can be attached to the right housing member 32(*a*) as well as the left housing member 32(*b*) (shown in FIG. 30) to adjust the rearward portion 106 of the shot indicating laser 100. In a similar manner, a set screw at the location 108 can be used to adjust the vertical orientation of the trigger prep indicator 102. In a preferred form the trigger prep indicator 102 is a laser. In one form the lasers are different colors such as the shot indicating laser 100 is green and the trigger prep indicator is a red laser where in other forms they are the same color such as for example both being red lasers.

A spring 120 and 122 is provided to bias the lasers towards set screws to allow for adjustment thereof. As shown in FIG. 3 the sets screws 124 and 125 are threadedly engaged to the left housing member 32(*b*) to adjust the rearward location of the lasers rearward locations of the shot indicating laser 100 and the trigger prep indicator 102.

As shown in FIG. 6 there is a power supply 128. In one form the power supply 128 is a conventional battery. As shown in FIG. 5 the power supply in one form is an electrical communication with the switch contact 130. The switch contact 130 in one form is configured to be interposed between the switch activating region 56 of the trigger bar 50 and the contact pad 132 as shown in FIG. 5. Therefore it can be appreciated as shown in FIG. 5 when the trigger bar is longitudinally forward whereas the trigger 40 is "pulled or pressed" longitudinally rearward the switch activation region 56 having an electrically conductive portion of the trigger bar 50 presses the switch contact 130 to be an electrical communication with the contact pad 132. The contact pad 132 can for example be a small piece of conductive rod such as bronze tubing and soldered to a lead such as a positive lead to the shot indicating laser 106. The contact pad or the battery contact 140 can for example be in contact with the negative portion of the battery where the negative lead for the shot indicating laser 100 is electronically attached thereto such as by soldering. In light form the negative contact for the trigger prep indicator 102 can be soldered to the contact 140.

With the foregoing description in place there will be discussion of the trigger movement detection system 150 as shown in FIG. 6. In general, the trigger movement detection system 150 is configured to determine the rotation of the trigger 40 and provide a signal of some form (visual, auditory, vibration, etc.) when the trigger is at a certain rotational position with respect to the frame 22 (shown in FIG. 3). As shown in FIG. 6, there is a trigger movement detector 152 which in one form is a sheet of metal that has a mounted portion 154 and a conductive end 156. Further, a trigger movement adjuster 158 can be provided which in one form is a set screw threadedly mounted at the location 160 which is a portion of the right housing member 32(*a*). Therefore, when the set screw presses the trigger movement detector downward the conductive end 156 moves downward closer towards the trigger movement member 162. In one form the trigger movement 160 is mounted at location 164 and the extension portion 166 is operatively configured to touch the conductive end 156 as the trigger 40 rotates. One preferred form this conduction is by two pieces of metal coming together but there could be optical sensors, rotational sensors etc. By having the upper portion 45 of the trigger 40 engage the trigger movement member 162, it has been found that this is a very economical way to detect the movement of the trigger and have the movement of the trigger translate into rotation of the trigger movement No. 162 which in this case is upward where the extension portion 166 will eventually come in contact with the conductive end 156 as shown in FIG. 6. Therefore, it can be appreciated that the exact activation of the trigger prep indicator 102 will occur based on where the trigger movement adjuster 158 positions the conductive end 156. In one form the conductive end 156 is positioned just hovering over the extension portion 166 so as soon as the trigger 40 is feathered (just barely touched) the current from the trigger movement No. 162 is passed to the trigger movement detector 152 which closes a circuit to the trigger prep indicator 102 whereby activating in one form a red laser. The trigger movement No. 162 as shown in FIG. 6 can be soldered to a wire which is then shown in FIG. 7 where this wire 170 passes longitudinally forward and in turn is soldered to the switch contact 130. Therefore, it can be appreciated that the trigger movement No. 162 is an electrical communication with one form of positive contact of battery (power source 128).

Figure 10A:
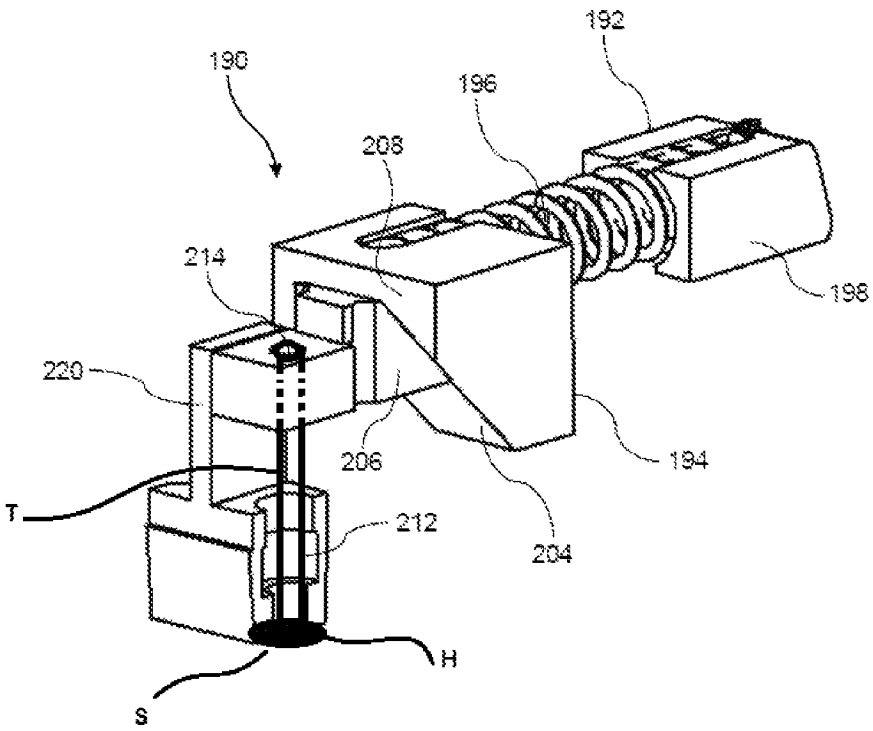
FIGS. 10 and 10A show isometric views of a few of the components comprising the trigger takeup adjustment system.
Figure 10:
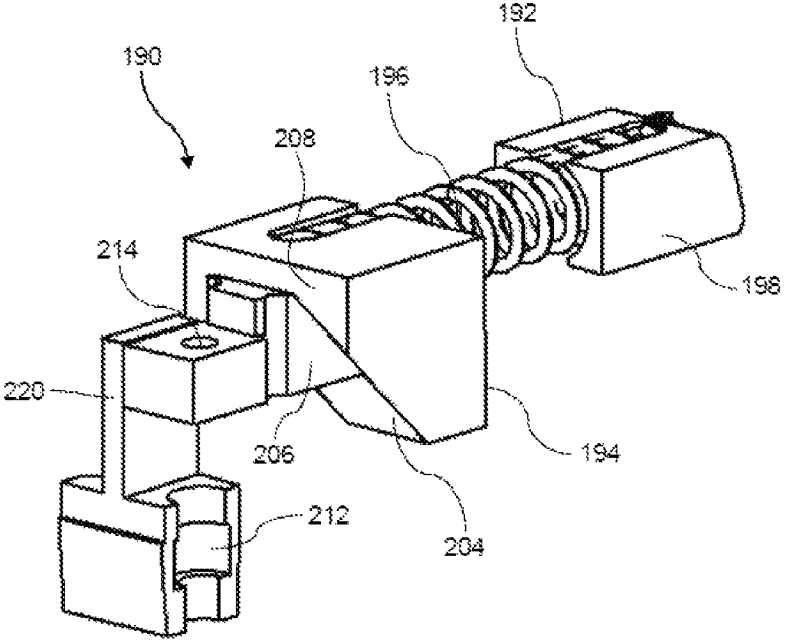
Figure 11:
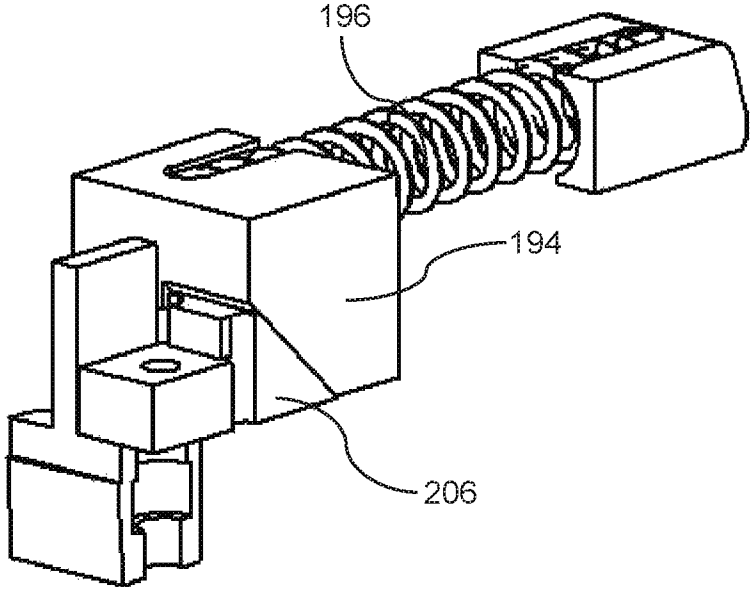
FIG. 11 shows the same components in FIG. 10 with a different orientation whereby the trigger prep adjuster is positioned vertically lower whereby adjusting the location of the prep adjustment block having less tension upon the biocine member (helical spring in one form)

With the foregoing description of the switching system for activating the shot indicator laser 100 and the trigger prep indicator 102, there'll be a final discussion of the trigger prep adjustment system as shown in FIGS. 10 and 11. As shown in FIG. 10 the trigger prep adjustment system 190 comprises a trigger engagement block (otherwise referred to as a trigger prep block) 192 and a prep adjustment block 194. Interposed between the trigger engagement block 192 and the prep adjustment block 194 is a second biasing member 196. As best shown in FIG. 10 the second biasing member 196 is attached or otherwise fitted to the blocks 192 and 194. The trigger engagement block 192 has a trigger engaging surface 198 where as shown in FIG. 8 this trigger engagement block is there behind the shield 200 and pressing the trigger 40 longitudinally rearward (whereas the finger engagement portion 46 is rotated longitudinally forward about the pivot point 42).

Referring back to FIG. 10, the prep adjustment block 194 has the angled surface 204 which is configured to engage the angled adjustment surface 208. The angle adjustment surface 208 is part of the trigger prep adjuster 206. In general, the trigger prep adjuster 206 is configured to move vertically upward whereas in one form a set screw with a screw head is mounted at the location 212 where the set screw is configured to remain in place but rotate and the threaded portion is configured to engage at the location 214 of the training prep adjuster 206 whereby moving the trigger prep adjuster 206 upward and downward. This upward and downward motion translates into the prep adjustment block 194 to move longitudinally forward and rearward whereby increasing the pretension on the second biasing member 196.

Figure 12A:
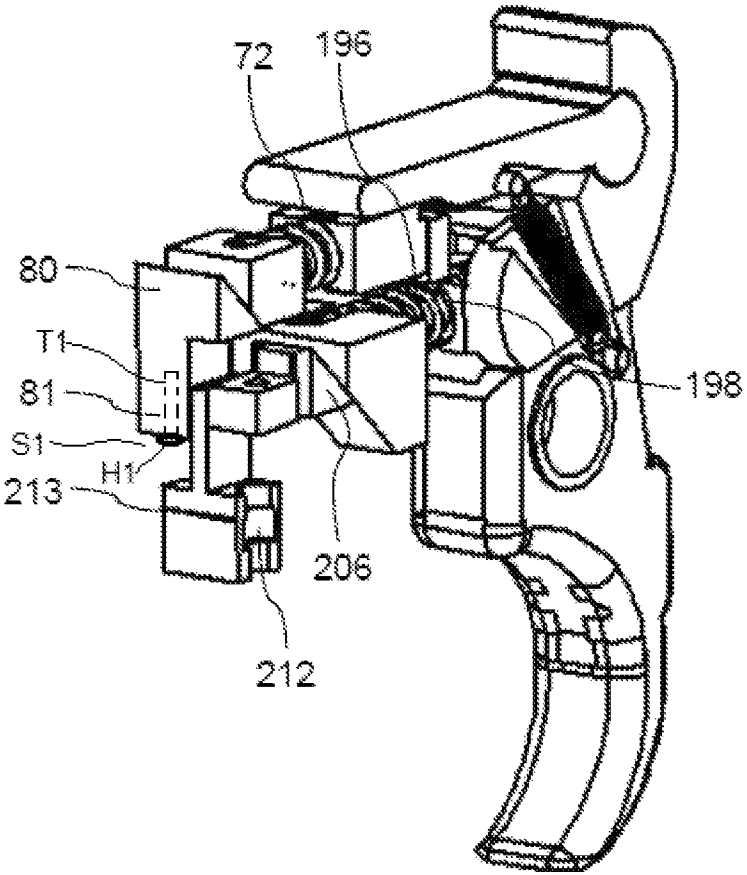
FIGS. 12 and 12A show isometric views of the trigger and the trigger break adjustment systems and the trigger prep adjustment system.
Figure 12:
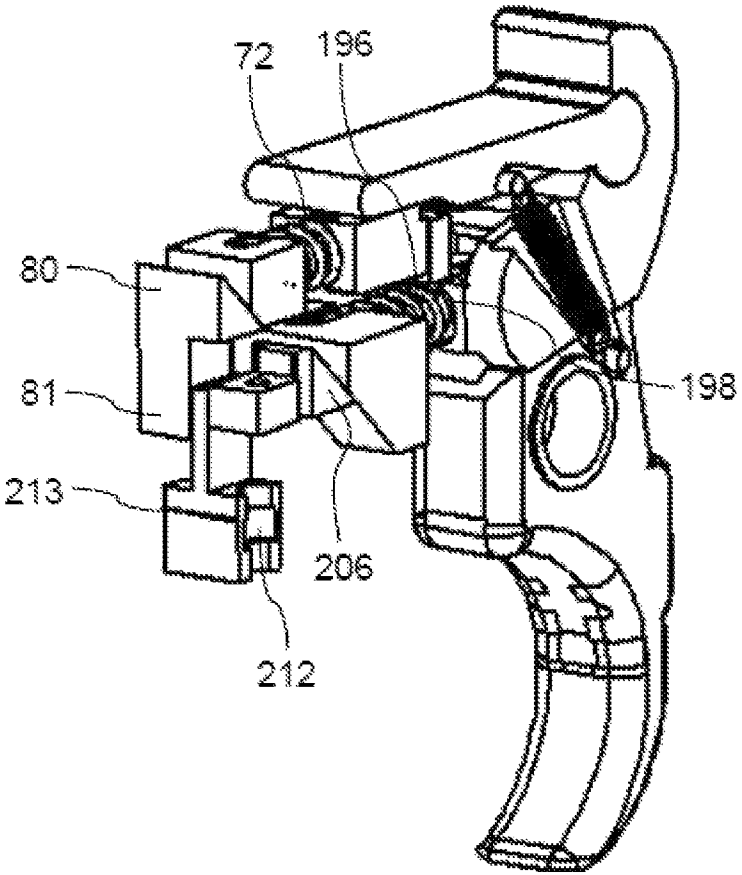

There can further be seen a separator 220 where the separator 220 separates the movement of the trigger prep adjuster 206 from the trigger break adjuster 80 (shown in FIG. 8). As shown in FIG. 12 the trigger break adjuster 80 is offset in a lateral direction with respect to the trigger prep adjuster 206. The set screw to adjust the trigger prep adjuster 206 can have a head placed at the location indicated at 212 whereas a second set screw at location 213 can have the head mounted therein and the threads engage the portion 81 of the trigger break adjuster 80 to reposition the trigger break adjuster vertically upward and downward. Therefore it can be appreciated that the biasing member 72 applies pretension thereupon by adjustment of the set screw at location 213 and further the second biasing member 196 can have pretension thereupon by adjusting the set screw which is configured to be mounted at location 212 (again referring to FIG. 12). Therefore it can now be appreciated that the general locations 212 and 213 are generally represented as extending through and out a surface of the grip frame 30 shown in FIG. 13 at the locations 212(*a*) and 213(*a*) (again shown in the isometric view in FIG. 13). Therefore a set screw can be placed therein through the locations 212(*a*) and 213(*a*) to adjust the trigger prep weight and the trigger break weight accordingly. This provides for external adjustments of these features of the trigger without having to remove any components.

As shown in FIG. 11 it can further be seen how the second biasing member 196 initial length can be adjusted where the trigger prep adjuster 206 is positioned longitudinally lower whereas the set screw in this case was turned clockwise to bring the trigger prep adjuster 206 vertically downward. It can be appreciated that the prep adjustment block 194 in turn was repositioned longitudinally forward whereby reducing the pretension on the second biasing member 196. Again to reiterate the components in FIG. 11 are positioned in the lower left portion of FIG. 8.

With the foregoing description in place there will be some final description and discussion on other portions for fully enabling description and best mode for carrying out the invention which is broadly defined in the claims below. FIG. 6 shows as front cap 240. In one form the front cap binds the pieces 32A and 32B (see FIG. 4) together and helping them stay together during assembly and disassembly.

Figure 14:
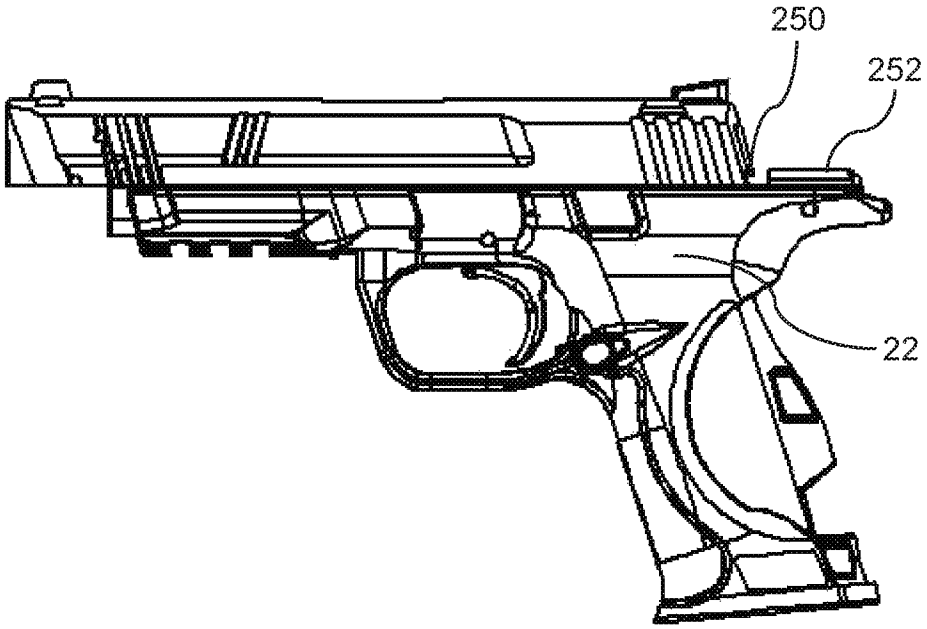
FIG. 14 shows the training pistol in a partially assembled view illustrating how the slide can fit to the frame in one form.

A attachment member such as a nut and bolt assembly can pass through the surface to find a new opening 242 where as shown in FIG. 4 the rearward portion of the module frame 32 can thereby be held together. While still referring to FIG. 4, the slide 36 in one form can have grooves indicated at 250 where these grooves are configured to attach to the wings 252 of the frame 22. Therefore, the slide as shown in FIG. 14 can be repositioned vertically downwardly and the wingless 252 will engage the grooves 250 whereby when the slide is repositioned longitudinally rearward with respect to the frame 22 a pin 260 can pass there through the frame as shown in FIG. 1 and extend through the opening 262 as shown in FIG. 3 to lock the slide to the frame 22 (where again the frame 22 is broadly defined as the components of the module frame 32 and the frame and the grip frame 30).

In another form, the trigger movement member can be integral with the trigger movement member 162 can be integral with the trigger bar 50 and be an electrical communication with a power source 128 whereby as the trigger bar moves forward the upper surface of the trigger movement member will engage the conductive end 156 of the trigger movement detector 152.

So in other words, the trigger movement member will be angled vertically downward so the conductive member's height can be adjusted by the trigger movement adjuster 158 to adjust when the trigger prep indicator 102 is activated (with respect to the rotation trigger 40). As further shown in FIG. 13 a grip pin attachment No. 270 is operatively configured to fit within the surface to find the opening 272 and a rear grip 274 is mounted to the handle region 24. Therefore, different sized grips can be attached to the handle region 24 depending on the shooter's sized hands or if very small hands a smaller shooter such as a small female or child can shoot without the rear grip.

Figure 13:
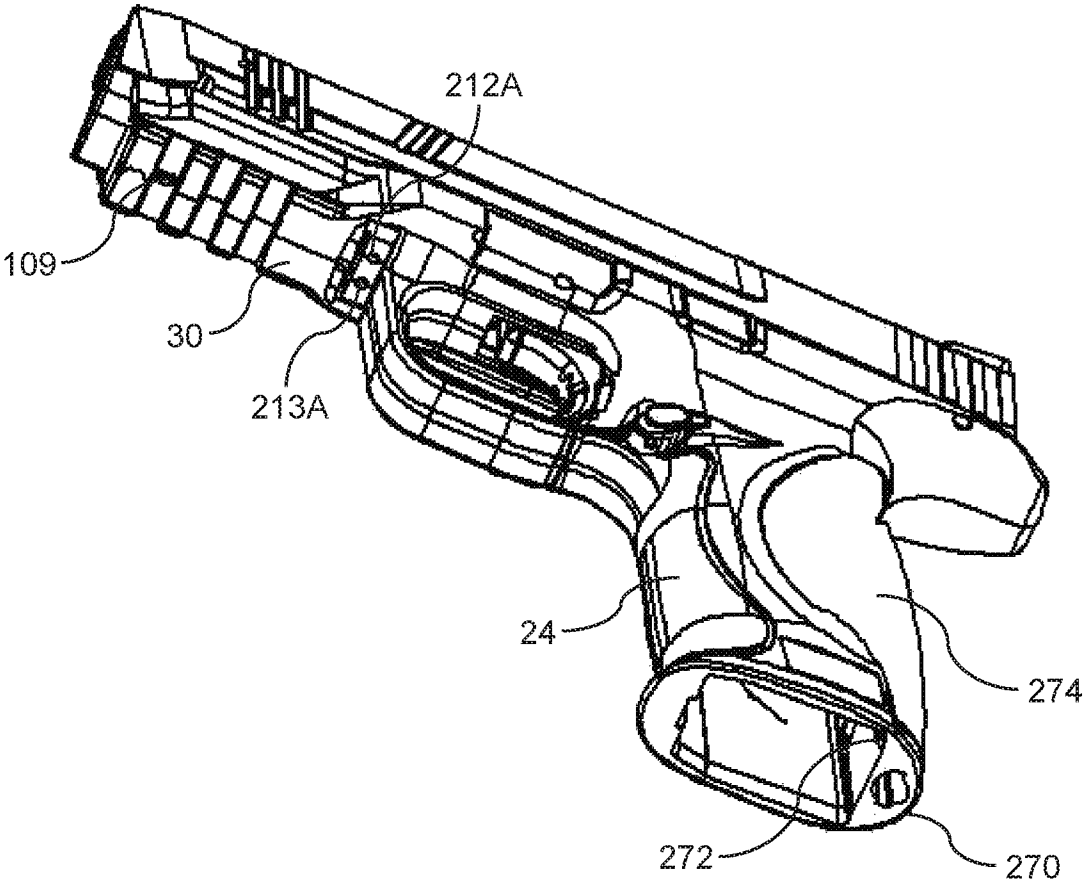
FIG. 13 shows an isometric view of the training pistol showing the lower portion and namely the access ports for adjusting the trigger prep and the trigger break.

As further shown in FIG. 13 the surface defining the opening at 109 is configured to have hex wrench to adjust a vertical orientation of the trigger prep indicator as shown in FIG. 6.

Figure 15:
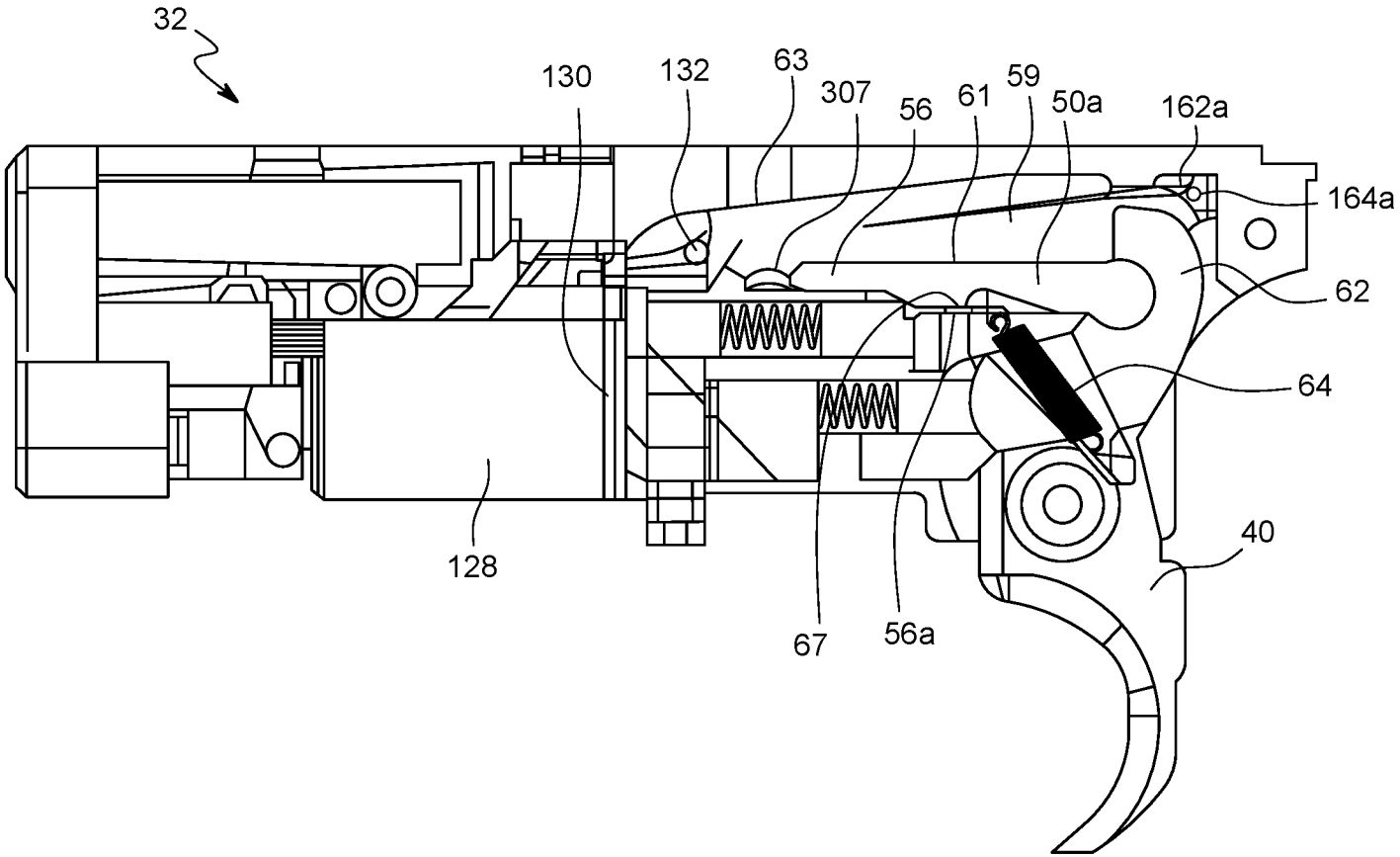
FIG. 15 shows a partial open portion of a training pistol illustrating a contact surface in forceful engagement with a contact pad for activating shot indicating laser, in accordance with another embodiment of the present disclosure.

Referring to FIG. 15, there is a switch activation region 56*a*, which is fixedly attached to the trigger bar 50*a*. The trigger bar 50*a* is attached in a similar manner at 54, the upper portion of the trigger 40. The trigger 40 is pivotally attached to the modular frame 32 in a similar manner as described above. Further, the trigger bar spring 62 is operatively configured to bias the trigger bar 50*a* downward (that is downward with respect to the orientation in FIG. 15), whereby forcefully engaging the trigger seer 56*a* of the trigger bar 50*a* to the lock seer 67 in a similar manner as described above.

Figure 16:
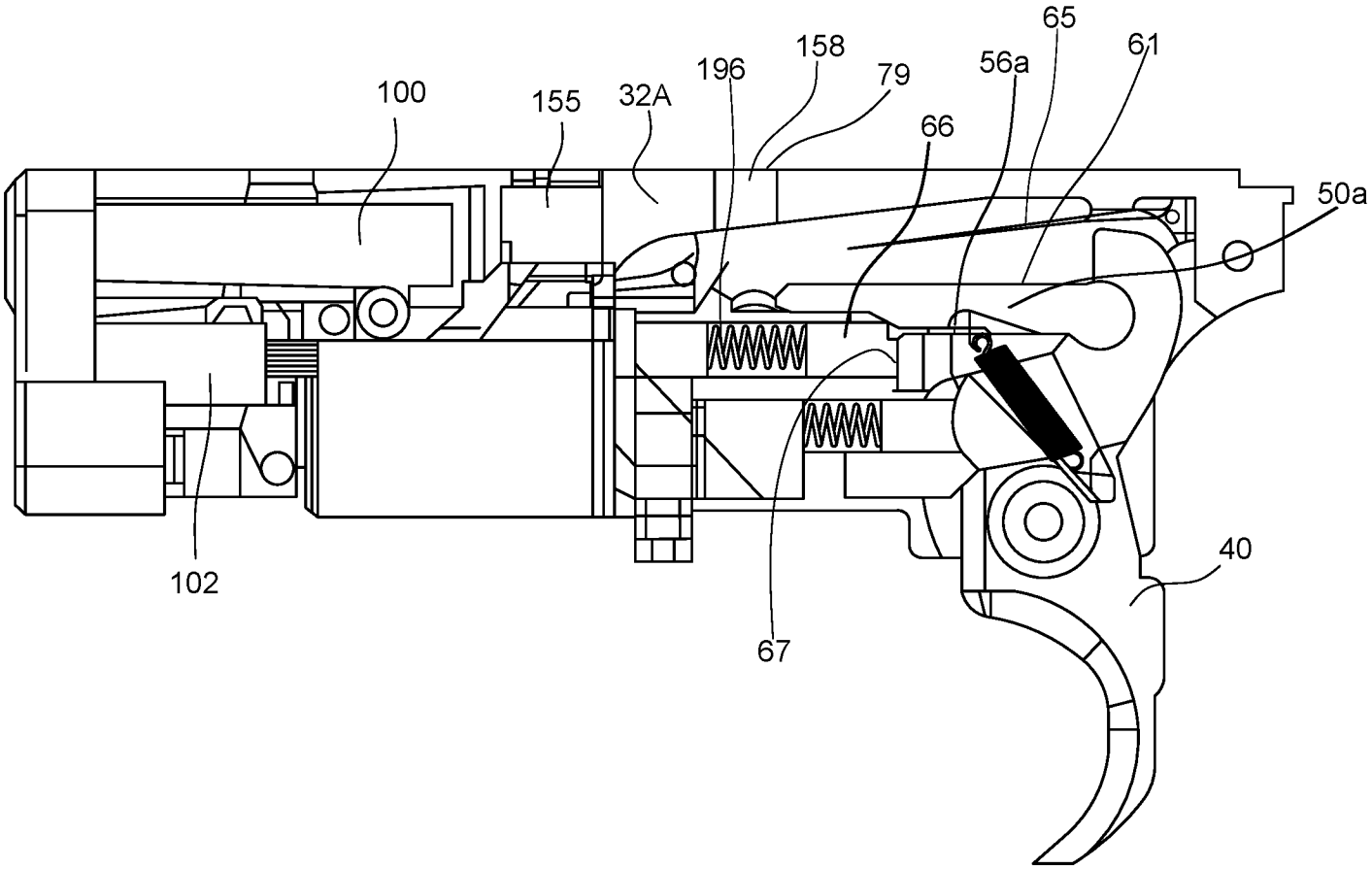
FIG. 16 shows a partial open portion of a training pistol of FIG. 15 illustrating a trigger in a "prepped" state, in accordance with another embodiment of the present disclosure.
Figure 17:
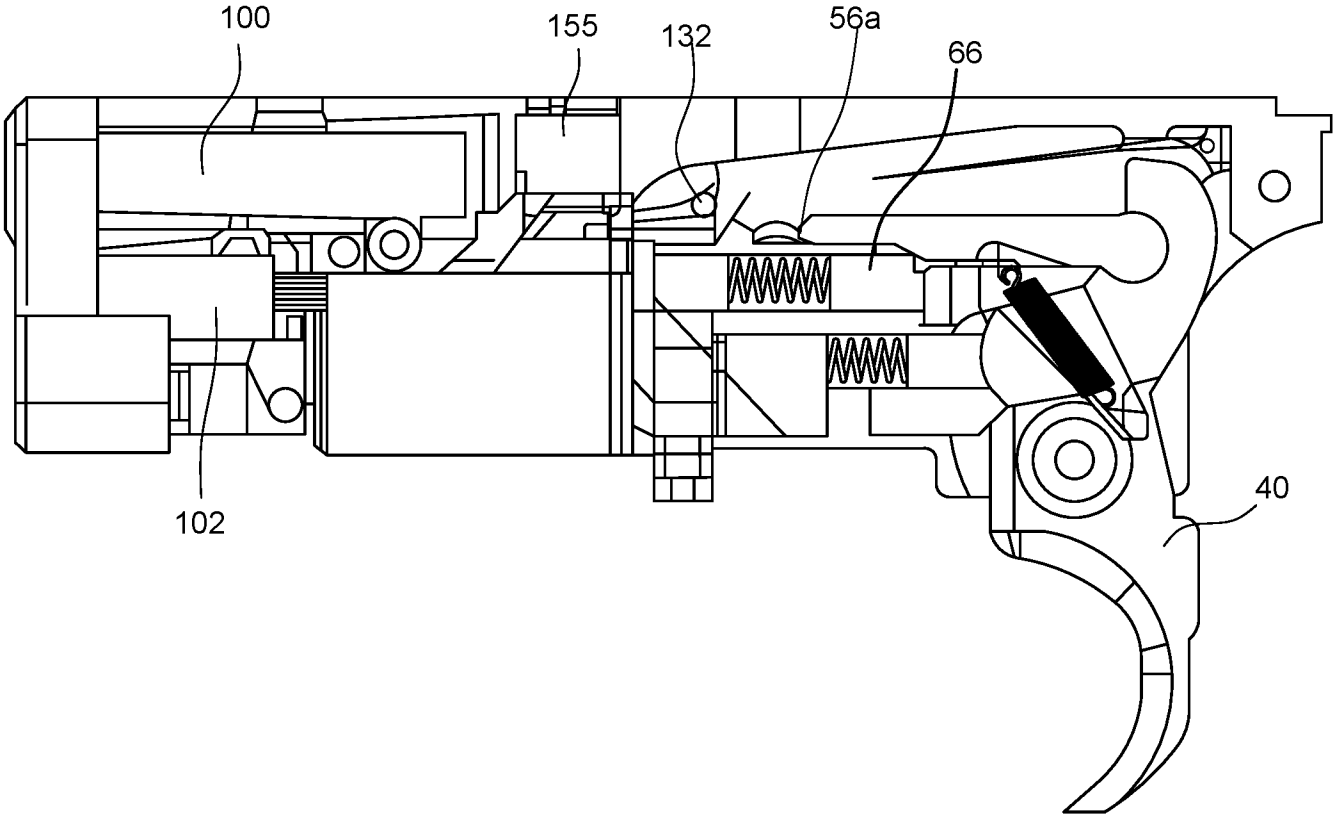
FIG. 17 shows a partial open portion of a training pistol of FIG. 15 illustrating a trigger fully pressed rearwardly to enable the contact surface is in electrical communication with the contact pad, in accordance with another embodiment of the present disclosure.

The embodiment that's shown in FIG. 15-17 provide an alternative way of routing the electricity from power supply 120H, which again in a preferred form, is a conventional battery such as a CR123 or a CR2 lithium-type, 3-volt battery that is configured to supply sufficient amperage and voltage to lasers. Therefore, the trigger movement member 162*a* has a location such as that near 164*a*, which is soldered to a conducted member such as wire which is fit along the channel 307, which, in turn, is soldered to a conductive member such as a bent piece of beryllium copper or similar conductive material to form the switch contact 130. The switch contact 130 in a preferred form is bias to engage either the positive or the negative portion of the power source/battery 128. FIGS. 15-17 show the battery in a configuration where the negative portion of the battery/power source 128 is in electrical communication with the switch contact 130.

Further, current such as current from the negative terminal of the power source 128 is supplied to the trigger movement member 162*a*. The trigger movement member 162*a* is in electrical communication with the trigger movement base 59. The trigger movement base 59 is fixedly attached to the trigger bar 50*a* in FIGS. 15-17. In one form, the trigger movement base 59 is a laser cut or otherwise profiled piece of metal, which, in one form, can be between 0.050 inches to 0.200 inches (not for limiting the scope but just as an example of a method for manufacture). In a preferred form, the trigger movement base is about 0.100 inches in thickness and substantially planar so it can be easily laser cut from a sheet of metal, preferably some form of stainless steel. In one form, the trigger movement base 59 is integral and a part of the trigger bar 50*a* where the trigger bar 50*a* is, for example, a plastic injection piece over molded the metallic conductive trigger movement base 59. In this one form of carrying out the embodiment, the trigger movement member 162*a* is biased downwardly toward the trigger movement base 59 to provide electrical communication therewith. Therefore, the battery/power source 128 has one of its terminals in electrical communication and constantly (in one form) charging the trigger movement base 59 with an electrical charge.

The trigger movement base 59 further has a contact surface 61 where the contact surface has a slope whereby motion of the trigger bar 50*a* to the left and right (with reference to the orientation in FIG. 15) provides a change in the vertical surface with respect to the housing. In other words, the contact surface 61 will approach and become closer to the switch contact 63 and, more specifically, the switch tip region 65. Therefore, as the trigger bar 50*a* moves to the left as the trigger 40 is rotating, the contact surface 61 will get closer to the switch tip region 65 whereby passing current thereto where the switch contact 63 is an electrical communication with the lasers in a similar manner as described above.

Basically, instead of having an inner posed switch contact 130 as shown in FIG. 5 where the upper portion of the switch contact 130 is between the switch activation region 56 of trigger bar 50 and the contact pad 132 (see FIG. 5 of the previous embodiment), in the embodiment of FIGS. 15-17, the contact surface 56*a* as shown in FIG. 15 is already electrically charged and as soon as the contact surface 56*a* comes in forceful engagement with the contact pad 132, the shot indicating laser is activated. For clarification, the switch contact 63 is configured to activate the trigger prep indicator (102 shown in FIG. 5).

Referring to FIG. 16 similar to FIG. 15 but in a different orientation whereby the trigger 40 is partially pressed rearwardly and this figure generally shows the trigger in a "prepped" state in fact, it's just about to what is conventionally called "the trigger break" or "the break". Directing attention to the surfaces 56*a* and 67, it can be appreciated that these surfaces act as mutual seer surfaces and as the trigger bar 50*a* is repositioned upwardly, these surfaces 56*a* and 67 are reaching a point of disengagement and the trigger block 66 which is under force by the second biasing member 196 will dynamically and forcefully pass thereunder the trigger bar to an orientation as shown in FIG. 17.

Referring back to FIG. 16, you can see that the switch tip region 65 is very close to be in electrical communication with the contact surface 61. In one form, the orientation of the switch tip region can be adjusted up and down by way of a set screw or other biasing member generally located at 79 where the set screw could, for example, be threadedly engaged to the right housing member 32*a*. Therefore, the set screw could be accessed from the upper portion to make an adjustment for biasing the switch tip region 65 downwardly to engage the contact surface 61 at any desirable location of the trigger bar 50*a* as it repositions from right to left. Therefore, as shown in FIG. 16 can be appreciated that the trigger take a laser (for convenience purposes is shown in FIG. 6 at 102) will be activated just as the trigger 40 pushes the trigger bar 50*a* a little bit more to the left in FIG. 16.

In one form the laser which is generally designated as a trigger prep indicator 102 in FIG. 6 cannot only be used to activate before a trigger break but could activate after a trigger break with this embodiment as shown in FIGS. 15-17. Therefore in yet another form, the switch 155 in FIG. 16 can be activated to allow electrical communication from the switch contact 63 to the trigger prep indicator 102 which is effectively now a second shot indicating laser. In one form, the upper laser which is generally the shot indicating laser noted at 100 is turned off by the switch 155 and the current is only directed to the trigger prep indicator 102 which is now a shot indicating laser. Therefore, it allows the end user to toggle between two different lasers. This configuration can be very handy because some targeting systems only activate with a certain type of laser. Therefore, if the laser indicated at 100 is green and the laser indicated at 102 is red, then we can have an orientation where the green laser is not used as a shot indicating laser but the lower red laser is. Thereby changing the switch configuration 155 to a different selector and further adjusting the switch tip region 65 upwardly by a trigger movement adjuster indicating at the location 158, we can now have the functionality of a trigger prep indicator (using the laser/trigger prep indicator 102 along with a shot indicator 100). In another form, if the switch 155 does not actually turn off the shot indicating laser 100, the end user can cover the output of the laser so it's not visible and not being shined on the target whereby only the laser 102 is hitting the target after the shooter breaks a shot.

In another form either one of the lasers 100 or 102 can be infrared or any electromagnetic frequency. FIG. 17 shows the trigger 40 fully pressed rearwardly where in this form the contact surface 56*a* is in electrical communication with the contact pad 132 whereby providing a complete circuit to an electrical communication with the contract pad 32 (in a similar manner as described above and generally shown in FIG. 6).

A trigger system for a training pistol is provided and now will be explained in conjunction with FIGS. 8, 10 and 10A, and 12 and 12A. The trigger system include a trigger assembly having a trigger 40 and a trigger bar 50 biasingly attached to the trigger 40; a primary adjustment system operatively coupled to the trigger assembly via the trigger bar 50, the primary adjustment system comprising a trigger adjustment block 74 having a first angled surface 76, a trigger block end 90, and a first biasing member 72 disposed between the trigger adjustment block 74 and the trigger block end 90; a secondary adjustment system 190 associated with the primary adjustment system, the secondary adjustment system 190 comprising a trigger engagement block 192, a die prep adjustment block 194 having a second angled surface 204, and a second biasing member 196 disposed between the trigger engagement block 192 and the die prep adjustment block 194; a trigger break adjuster 80 having a third angled surface 82 associated with the first angled surface 76 of the trigger adjustment block 74 in the primary adjustment system; a trigger prep adjuster 206 having a fourth angled surface 208 associated with the second angled surface 204 in the die prep adjustment block 194; and a separator 220 configured to separate the movement of the trigger prep adjuster 206 with the trigger break adjuster 80.

In one embodiment, the trigger adjustment block 74 and the trigger block end 90 comprises a respective cavity therein to accommodate distal end portions of the first biasing member 72.

In one embodiment, the trigger engagement block 192 and the die prep adjustment block 194 comprises a respective cavity therein to accommodate distal end portions of the second biasing member 196.

In one embodiment, the trigger break adjuster 80 is offset in a lateral direction with respect to the trigger prep adjuster 206.

In one embodiment, the trigger break adjuster 80 comprises a threaded location 214 configured therein. Further, the separator 220 comprises a mounting location 212 (also called as location 212). Furthermore, the threaded location 214 and the mounting location 212 accommodate a first screw extending from the mounting location 212 to the threaded location 214.

In one embodiment, the first screw 'S' comprises a screw head 'H' and a threaded portion 'I' extending from the screw head 'H'. The screw head 'H' rests at the mounting location 212, whereas the threaded portion 'T' extends up to the threaded location 214.

In one embodiment, the first screw 'S' is adapted rotate in the threaded location 214 and the mounting location 212 to move the trigger prep adjuster 206 upward and downward, in turn longitudinally moving the prep adjustment block 194 in forward and rearward direction, whereby increasing the pretension on the second biasing member 196.

In one embodiment, the trigger break adjuster 80 comprises an engaging portion 81 to accommodate a second screw S1.

In one embodiment, the second screw S1 comprises a head portion and threaded portion 'T1' extending into the engaging portion 81 to reposition the trigger break adjuster 80 vertically upward and downward in turn applying pretension on the first biasing member 72.

In one embodiment, the trigger system further comprises a shot indicating laser and a trigger prep indicating laser. The primary adjustment system is configured to switch on the shot indicating laser, and the secondary adjustment system 190 is configured to trigger prep indicating laser.

An adjustment system for a training pistol is provided and now will be explained in conjunction with FIGS. 1-7A. The adjustment system includes a housing member having a right housing member 32(*a*), and a left housing member 32(*b*) coupled to each other, the housing member having: a shot indicating laser 100, and a trigger prep indicator 102 disposed adjacent to the shot indicating laser 100, a trigger assembly having a trigger movement member 162 adapted to be actuated vertically upon a rearward movement of a trigger in the trigger assembly, a conductive member 156 disposed adjacent to the trigger movement member 162, a primary adjustment system coupled to the trigger assembly to switch on the shot indicating laser 100, the primary adjustment system having a first biasing member 72, a secondary adjustment system disposed adjacent to the primary adjustment system to switch on the trigger prep indicator 102, the secondary adjustment system having a second biasing member 196; a first screw-set 124 disposed on the housing member to operatively coupled to the shot indicating laser 100 to rotatingly adjust the shot indicating laser 100; a second screw-set 125 disposed on the housing member to operatively coupled to the trigger prep indicator 102 to rotatingly the trigger prep indicator 102; a third screw-set 158 disposed on the housing member to operatively coupled the conductive member 156 to rotatingly adjust the conductive member 156; and a pair of fourth screw-set 215 disposed on the housing member to couple to the first biasing member 72 and the second biasing member 196, wherein the first, second, third and the pair of fourth screw set adapted to be rotated from across respective housing locations of the housing member for external adjustments of the shot indicating laser 100, the trigger prep indicator 102, the conductive member 156, and the first and second biasing members 72,196, respectively, without having to remove the right housing member 32(*a*), and the left housing member 32(*b*) of the housing member.

In one embodiment, the first screw-set 124 is coupled to the right housing member 32(*a*) of the housing member to adjust a rearward portion 106 of the shot indicating laser 100.

In one embodiment, the second screw-set 125 is coupled to the left housing member 32(*b*) of the housing member to adjust a rearward portion 106 of the trigger prep indicator 102 to adjust a vertical orientation of the trigger prep indicator 102.

In one embodiment, the adjustment system further includes a first spring 120 disposed within the housing member to bias the shot indicating laser 100 towards the first screw-set 124 to allow adjustment of the shot indicating laser 100.

In one embodiment, the adjustment system includes a second spring 120 disposed within the housing member to bias the trigger prep indicator 102 towards the second screw-set 125 to allow adjustment of the trigger prep indicator 102.

In one embodiment, the third screw-set 158 is threadedly mounted to the right housing member 32(*a*) to press the conductive end 156, downwards closer towards the trigger movement member 162.

In one embodiment, the trigger prep indicator 102 is adapted to be activated based on where the third screw-set 158 positions the conductive end 156.

In one embodiment, the pair of fourth screw-set 215 are coupled to at least one of the right housing member 32(*a*) and the left housing member 32(*b*) of the housing member to provide tension in the first biasing member 72 and the second biasing member 196 to adjust the primary and secondary adjustment systems.

In one embodiment, each of the first biasing member 72 and the second biasing member 196 is spring.

In one embodiment, each of the first, second, third and the pair of fourth screw set comprises: a screw 124, 125, 158, 215 having a head 124*a*, 125*a*, 158*a*, 215*a* and a threaded rod 124*b*, 125*b*, 158*b*, 215*b* extending from the head, wherein the head rest on the housing member at respective locations 111, 108, 160, 112 & 113 thereof and the threaded rod is movingly engaged with a hole 111*a*, 108*a*, 160*a*, 112*a* & 113*a* in the housing member.

What is claimed is:

1. An adjustment system for a training pistol, the adjustment system comprising:

a housing member having a right housing member-, and a left housing member coupled to each other, the housing member having:

a shot indicating laser and a trigger prep indicator, wherein the trigger prep indicator is disposed adjacent to the shot indicating laser, a trigger assembly having a trigger movement member adapted to be actuated vertically upon a rearward movement of a trigger in the trigger assembly, a conductive member disposed adjacent to the trigger movement member, a primary adjustment system coupled to the trigger assembly to switch on the shot indicating laser, the primary adjustment system having a first biasing member, a secondary adjustment system disposed adjacent to the primary adjustment system to switch on the trigger prep indicator, the secondary adjustment system having a second biasing member;

a first screw-set disposed on the housing member to be operatively coupled to the shot indicating laser, wherein the first screw-set is rotated inwardly or upwardly to adjust the shot indicating laser;

a second screw-set disposed on the housing member to be operatively coupled to the trigger prep indicator, wherein the second screw-set is rotated inwardly or upwardly to adjust the trigger prep indicator;

a third screw-set disposed on the housing member to be operatively coupled to the conductive member, wherein the third screw-set is rotated inwardly and upwardly to adjust the conductive member; and a fourth screw-set having a pair of screws, wherein the pair of screws are disposed on the housing member to be coupled to the first biasing member and the second biasing member, wherein the pair of screws are rotated inwardly and upwardly to adjust the first biasing member and the second biasing member, wherein the first, second, third and the pair of fourth screw sets enable external adjustments of the shot indicating laser, the trigger prep indicator, the conductive member, and the first and second biasing members, respectively, without having to remove the right housing member, and the left housing member of the housing member.

2. The adjustment system of claim 1, wherein the first screw-set is coupled to the right housing member of the housing member to adjust a rearward portion of the shot indicating laser.

3. The adjustment system of claim 1, wherein the second screw-set is coupled to the left housing member of the housing member to adjust a rearward portion of the trigger prep indicator to adjust a vertical orientation of the trigger prep indicator.

4. The adjustment system of claim 1 further comprising a first spring disposed within the housing member to bias the shot indicating laser towards the first screw-set to allow adjustment of the shot indicating laser.

5. The adjustment system of claim 1 further comprising a second spring disposed within the housing member to bias the trigger prep indicator towards the second screw-set to allow adjustment of the trigger prep indicator.

6. The adjustment system of claim 1, wherein the third screw-set is threadedly mounted to the right housing member to press the conductive end, downwards closer towards the trigger movement member.

7. The adjustment system of claim 6, wherein the trigger prep indicator is adapted to be activated based on where the third screw-set positions the conductive end.

8. The adjustment system of claim 1, wherein the pair of fourth screw-set are coupled to at least one of the right housing member and the left housing member of the housing member to provide tension in the first biasing member and the second biasing member to adjust the primary and secondary adjustment systems.

9. The adjustment system of claim 1, wherein each of the first biasing member and the second biasing member is spring.

10. The adjustment system of claim 1, wherein each of the first, second, third and the pair of fourth screw set comprises: a screw having a head and a threaded rod extending from the head, wherein the head rest on the housing member at respective location thereof and the threaded rod is movingly engaged with a hole in the housing member.

* * * * *